US006523974B2

(12) United States Patent
Engel

(10) Patent No.: US 6,523,974 B2
(45) Date of Patent: Feb. 25, 2003

(54) LAMP COVER

(76) Inventor: Hartmut S. Engel, Monrepos Strasse 7, Ludwigsburg (DE), 71634

( * ) Notice: Subject to any disclaimer, the term of this patent is extended or adjusted under 35 U.S.C. 154(b) by 0 days.

(21) Appl. No.: 09/812,919

(22) Filed: Mar. 19, 2001

(65) Prior Publication Data

US 2002/0003698 A1 Jan. 10, 2002

(30) Foreign Application Priority Data

Mar. 20, 2000 (DE) ..... 100 13 755

(51) Int. Cl.[7] ..... F21S 4/00

(52) U.S. Cl. ..... 362/224; 362/260; 362/223; 362/147

(58) Field of Search ..... 362/224, 33, 145, 362/147, 150, 260, 404, 414, 418, 222, 223, 290, 291, 292, 308, 317, 320, 362, 353, 359, 366, 367, 368, 433, 455, 457, 311, 351, 355

(56) References Cited

U.S. PATENT DOCUMENTS

| | | | | | |
|---|---|---|---|---|---|
| 4,891,737 | A | * | 1/1990 | Szymanek | 362/223 |
| 5,117,342 | A | * | 5/1992 | Vlah | 362/217 |
| 5,746,502 | A | * | 5/1998 | Huang | 362/223 |
| 5,823,663 | A | * | 10/1998 | Bell et al. | 362/260 |
| 5,988,829 | A | * | 11/1999 | Holder | 362/147 |

* cited by examiner

*Primary Examiner*—Thomas M. Sember
*Assistant Examiner*—John Amarantides
(74) *Attorney, Agent, or Firm*—Townsend and Townsend and Crew LLP

(57) ABSTRACT

A lamp has a light housing and a light cover intended to restrict dazzle, wherein the lamp cover comprises at least one areal element having a pre-selectable light transmission and made of elastic material which extends between the end walls of the lamp housing and is fixable in complementary recesses in the face walls via coupling lugs after an elastic deformation resulting in a shortening and a subsequent relaxation.

8 Claims, 5 Drawing Sheets

LAMP COVER

BACKGROUND OF THE INVENTION

The invention relates to a lamp, in particular for elongate lighting means with caps at both ends, having a lamp housing and a lamp cover provided to restrict dazzle.

Lamps having a lamp cover provided to restrict dazzle are known in the most diverse embodiments, with the lamp cover usually consisting of a molding matched to the special lamp design or of a plurality of special moldings assembled to form a cover.

SUMMARY OF THE INVENTION

It is an object of the present invention to provide a lamp having a lamp cover which can be manufactured in an easily variable design in a particularly economic manner, which is characterized by low weight and which moreover allows a simple and problem-free changing of the lighting means.

This object is satisfied in accordance with the invention essentially in that the lamp cover comprises at least one areal element which has a pre-selectable light transmission and is made of elastic material which extends between the end walls of the lamp housing and is fixable in complementary recesses in the end walls via coupling lugs after an elastic deformation resulting in a shortening and a subsequent relaxation.

The areal element or each areal element is here preferably positively latched in the end walls through its own stress.

Since the areal elements consist of elastic material, they can be bent simply, with the length of the respective element being shortened by the bending so that it is possible to insert the coupling lugs provided at the end sides into the corresponding recesses in the faces of the lamp housing without problem. The coupling lugs enter into the corresponding recesses by a simple release of the areal elements initially held in the bent or curved state, are preferably positively received there, and latch and thus hold the areal element in the desired defined position by its own stress.

It is particularly advantageous in connection with this basic principle that both cubic planar covers and convexly or concavely arched covers can be created by the selection of the planar length of the areal elements, with it only being necessary to pre-set the desired dimension of the respective arching by pre-setting the corresponding length dimension.

With respect to the variability of the design in accordance with the invention and its different application purposes, it is of advantage that, for example, only one lower areal cover element, or one lower areal cover combined with one lateral cover element or combined with two lateral cover elements, can be associated with the respective lighting means so that the respectively desired radiation characteristics or relationships can be taken into account. Since each areal element represents a unit which can be independently latched to the respective face areas of the lamp housing, the respectively required selection can be made without problem.

The stability of the shape of a light means cover consisting of a plurality of areal elements can preferably be further improved by latches being provided formed between the individual areal elements, e.g. by punched-out openings at one element and spigots at the other element.

An unintentional release of the lamp cover, such as cannot be excluded, for example, with simply clamped covers, is precluded with certainty in the solution in accordance with the invention due to the permanently active own stress after the completed assembly of the areal elements.

As a rule, only the central cover has to be removed to change the respective lighting means, which is possible in a simple manner by it being bent in a direction which shortens the areal element and uncouples it from the lamp housing.

BRIEF DESCRIPTION OF THE INVENTION

Further particularly advantageous embodiments and features of the invention are explained in more detail with reference to the drawing, in which.

DESCRIPTION OF THE PREFERRED EMBODIMENTS

Figure 1:
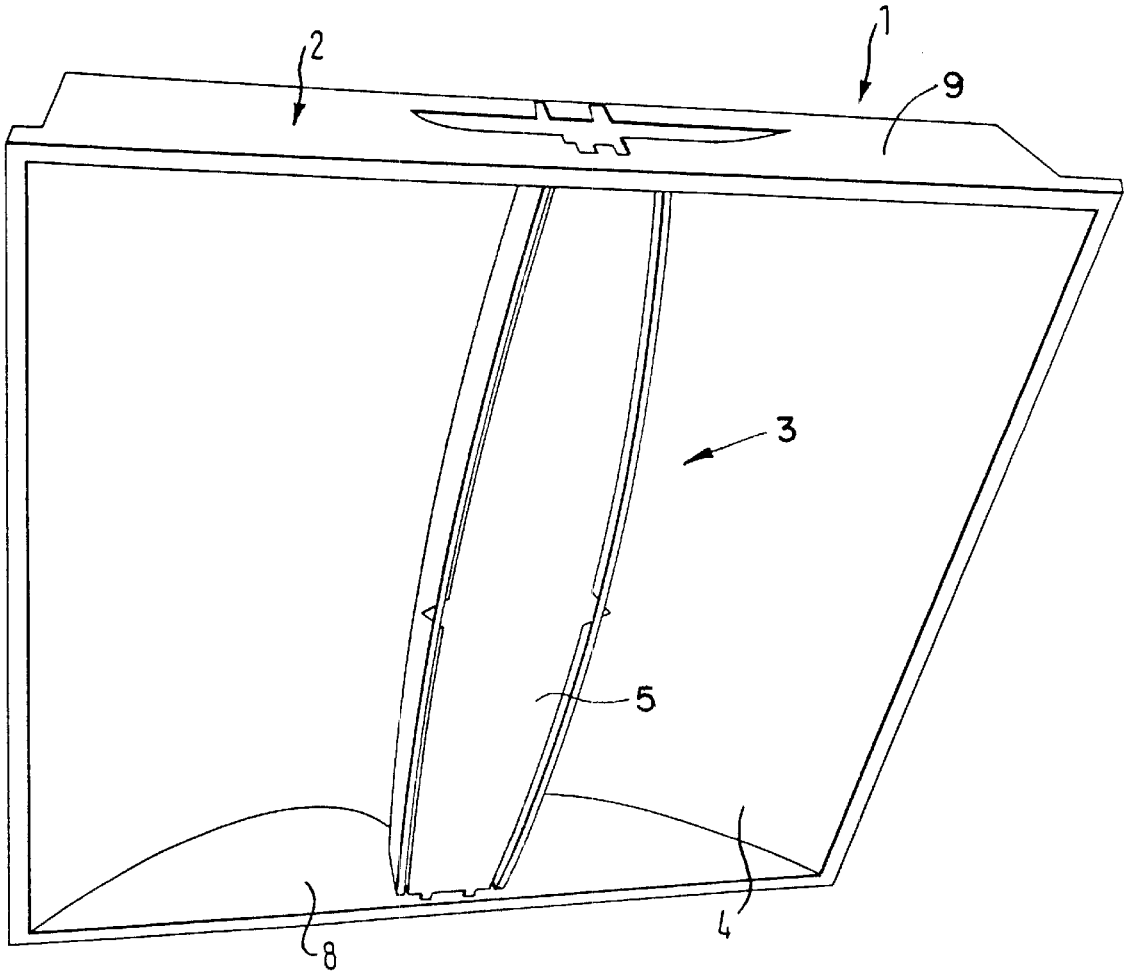
FIG. 1 is a schematic perspective representation of an embodiment of a lamp having a lamp cover in accordance with the invention.

FIG. 1 shows a lamp 1 intended for ceiling mounting having a lamp housing 2 and a lamp cover 3 spaced from and surrounding the elongate lighting means with caps at both ends which extends between the two end walls 8, 9 of the lamp housing 2. The lamp housing 2 furthermore receives a reflector 4, for example a reflector curved in a twin paraboloid manner. It has to be noted here that reflectors of the most varied kind and housing designs of a varied kind can generally be used in connection with a lamp in accordance with the invention.

Figure 2:
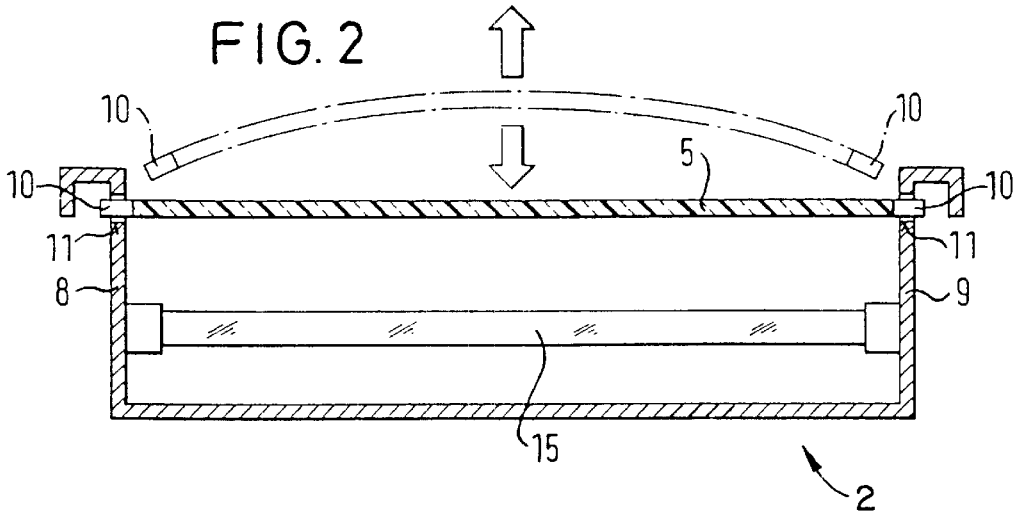
FIG. 2 is a schematic longitudinally sectioned view of a lamp housing having a planar lamp cover.

The schematic sectioned view in accordance with FIG. 2 shows a box-like lamp housing 2 having end walls 8, 9 between which an elongate lighting means 15 and an areal element 5 acting as a lamp cover 3 extend.

This light-transmitting, light-scattering and elastically formed areal element 5 preferably consists of a suitable plastic and is latched in the end walls 8, 9 of the lamp housing 2 in corresponding recesses 11 via coupling lugs molded at the end side. This is done by the areal element 5—as shown by a chain line—first being deformed by bending and thus being shortened in length, whereupon its coupling lugs 10 can be arranged in front of the recesses 11 in the end walls 8, 9 and then released for relaxation so that the coupling lugs 10 engage into the recesses 11 and thus fix the areal element 5 in place securely and exactly positioned by the return of the areal element 5 into its extended shape. In the case of FIG. 2, the length of the areal element 5 is selected such that it assumes a planar form in the fixed position.

Figure 3:
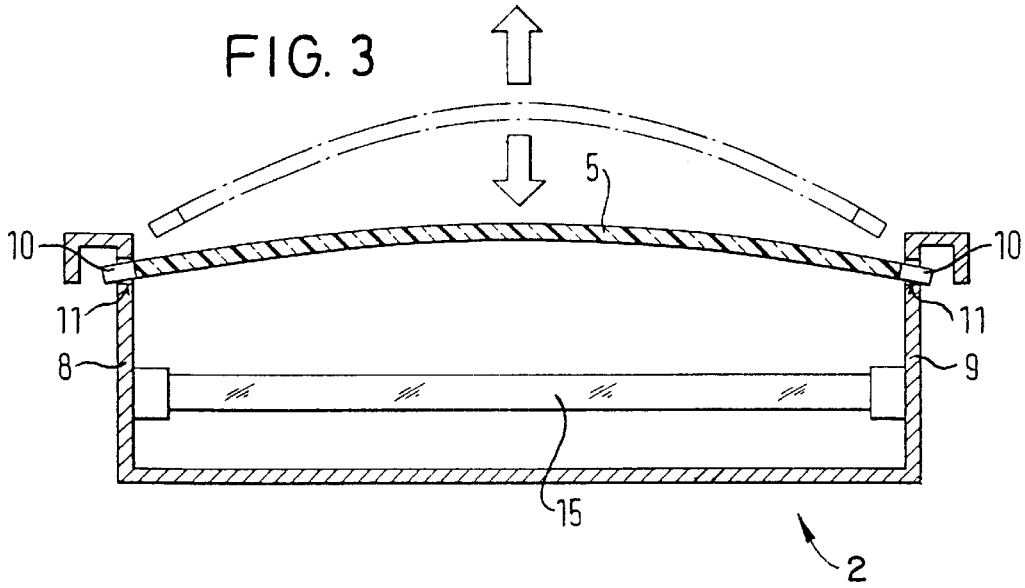
FIG. 3 is a schematic longitudinally sectioned view of a lamp cover having a convexly arched lamp cover.

FIG. 3 shows an embodiment in which the length of the areal element 5 is selected to be greater than the distance between the two end walls 8, 9 of the lamp housing 2. Since in this case the length of the areal element 5 means that it cannot relax in a planar manner after coupling with the lamp housing 2, a concavely arched structure of the cover 3 is achieved due to the residual stress of the areal element 5.

Figure 4:
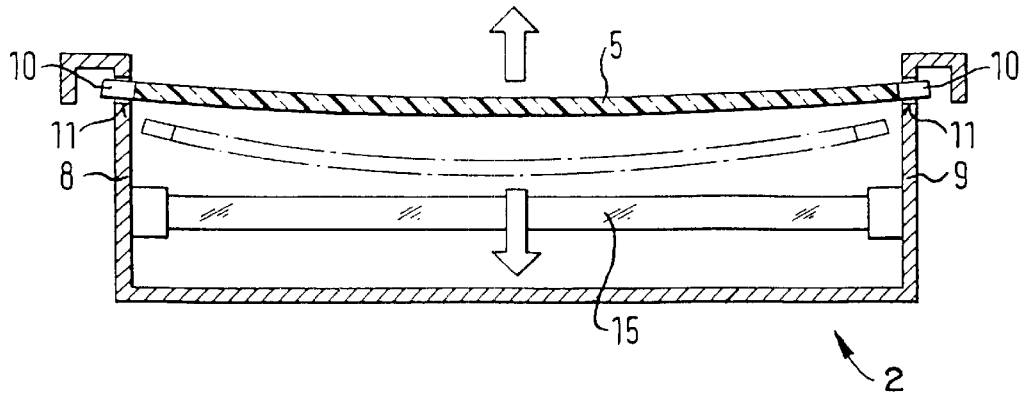
FIG. 4 is a schematic longitudinally sectioned view of a lamp cover having a concavely arched lamp cover.

FIG. 4 shows a basic arrangement corresponding to FIG. 3 with a correspondingly dimensioned areal element 5; however, in this case, the arching of the areal element has been carried out in the opposite direction so that a concavely arched cover structure results in the latched state of the areal element 5.

Since the lamp cover in accordance with the invention consists of individual areal elements, the number of the areal elements to be used in an individual case and also their relative positions can be freely selected depending on the desired radiation characteristics, with, in the event of different relative positions, only correspondingly matching recesses 11 also having to be provided in the end walls of the lamp housing.

Figure 5:
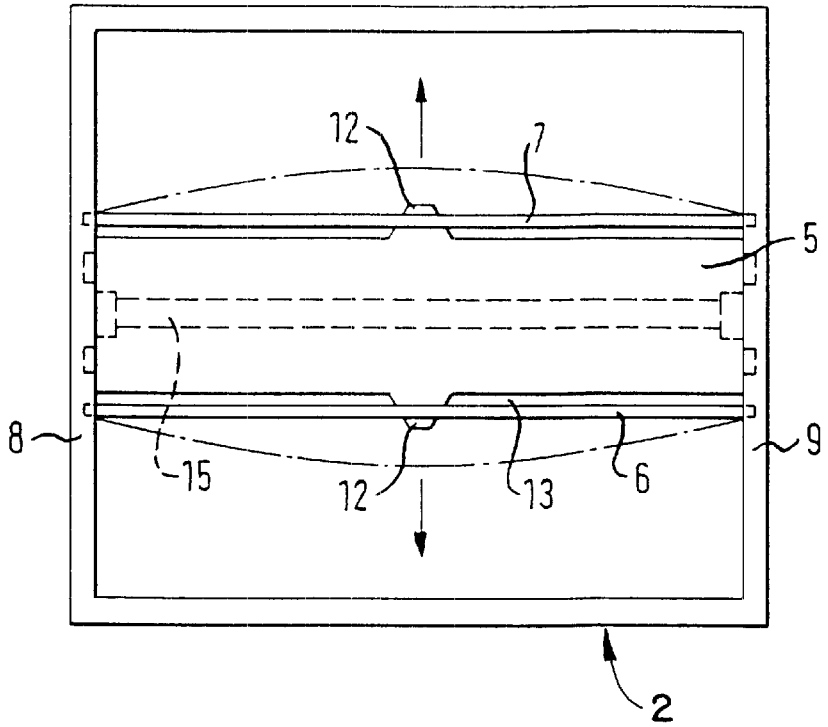
FIG. 5 is a schematic bottom view of a lamp having a cubic planar lamp cover.

FIG. 5 shows a bottom view of a lamp in which the lamp cover is executed in a cubic planar manner; i.e. a central areal element 5 is arranged between two lateral areal elements 6, 7. Additional latches 12 on opposite sides, which can be realized for example by punched-out openings and spigots engaging into these, can be provided between the central areal element 5 and the lateral areal elements 6, 7 to increase the overall stability and for the exact definition of the mutual spacings. In this way, exact gaps 13 extending in a defined manner can be achieved between adjacent areal elements.

The principle of convex and concave stressing of areal elements was already explained in connection with FIGS. 3 and 4. This principle cannot only be used for an individual areal element, but it can also be realized in connection with box-like lamp covers such as is shown schematically in FIGS. 6 and 7.

Figure 6:
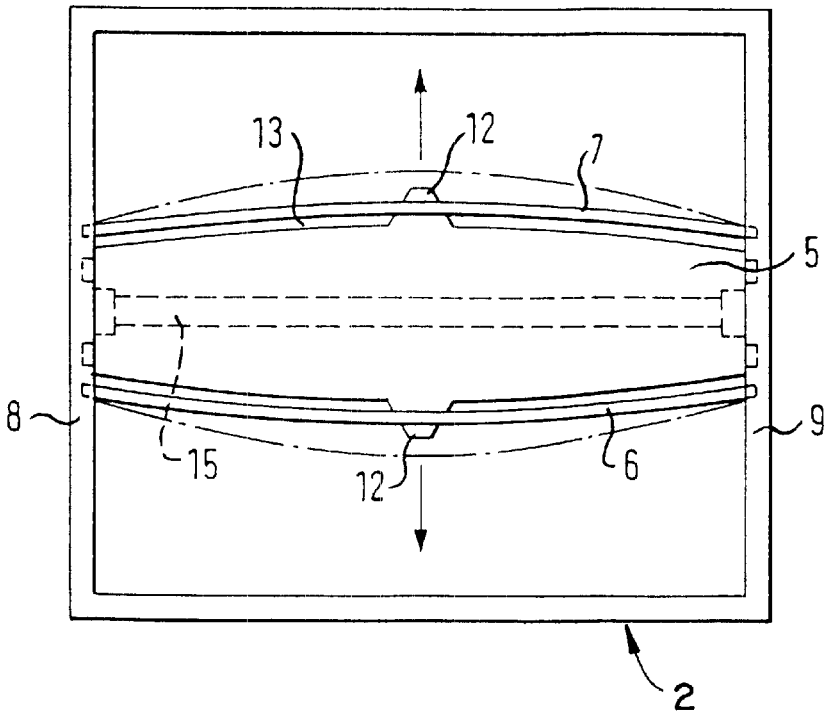
FIG. 6 is a schematic bottom view of a lamp having convexly arched areal elements of a lamp cover.

FIG. 6 shows a central areal element 5 whose two longitudinal sides are convexly shaped and which extends in at least substantially planar manner between the two faces 8 and 9 of the housing 2. Lateral areal elements 6, 7 are associated with this central areal element 5 and are stressed in the lamp housing 2 due to their selected length dimension such that the required matching to the contour of the central areal element is obtained. Inter-engaging latched connections 12 can also be provided here between the areal elements.

Figure 7:
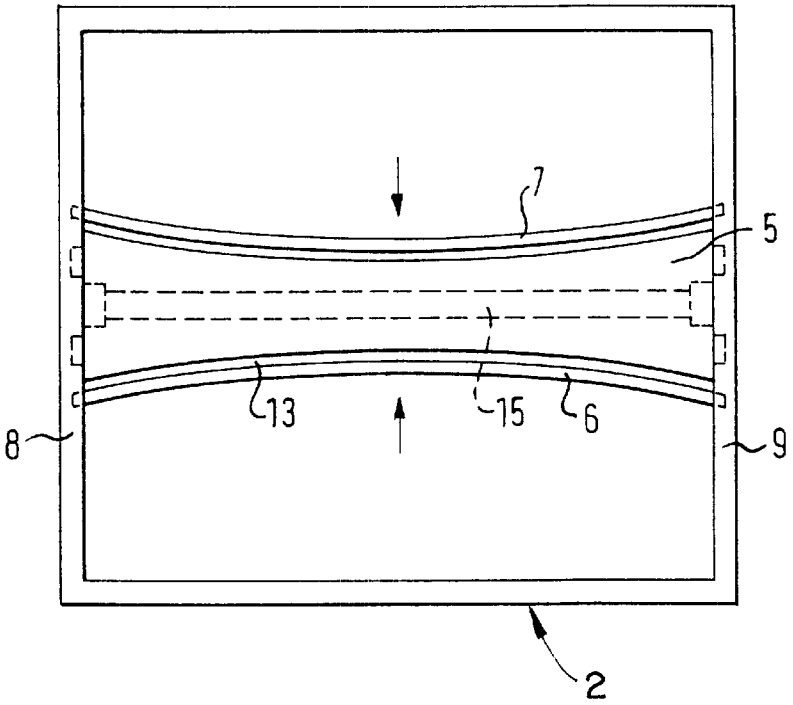
FIG. 7 is a schematic bottom view of a lamp having concavely executed areal elements of a lamp cover.

The embodiment in accordance with FIG. 7 differs from the embodiment of FIG. 6 in that the central areal element 5 has concavely extending side boundaries and in that the lateral elements 6, 7 are stressed in a curved manner towards the center and in this way match the shape of the central areal element 5.

Figure 8:
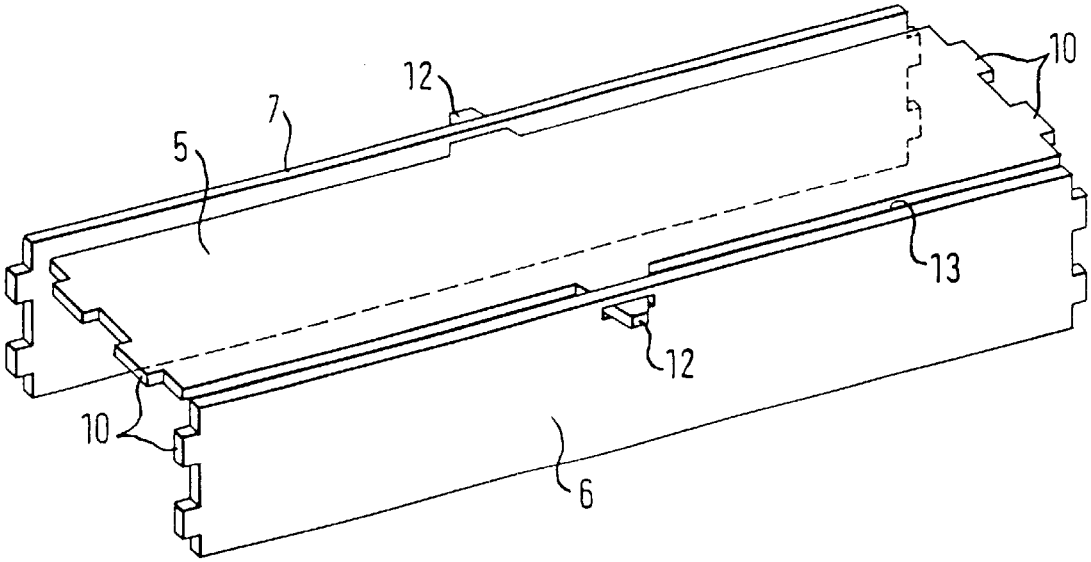
FIG. 8 is a perspective representation of the design of the lamp cover in accordance with FIG. 5.
Figure 9:
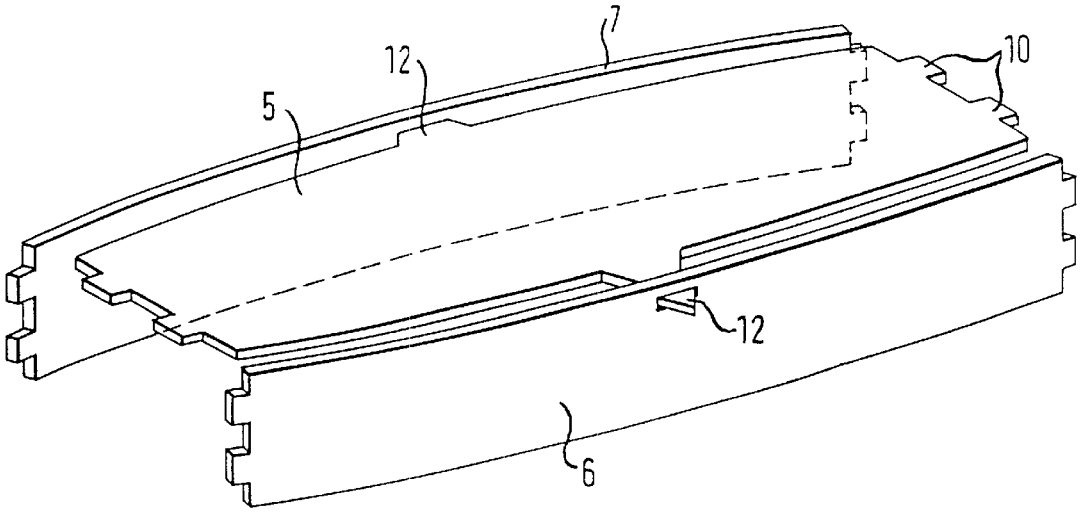
FIG. 9 is a perspective representation of the design of a lamp cover in accordance with FIG. 6.
Figure 10:
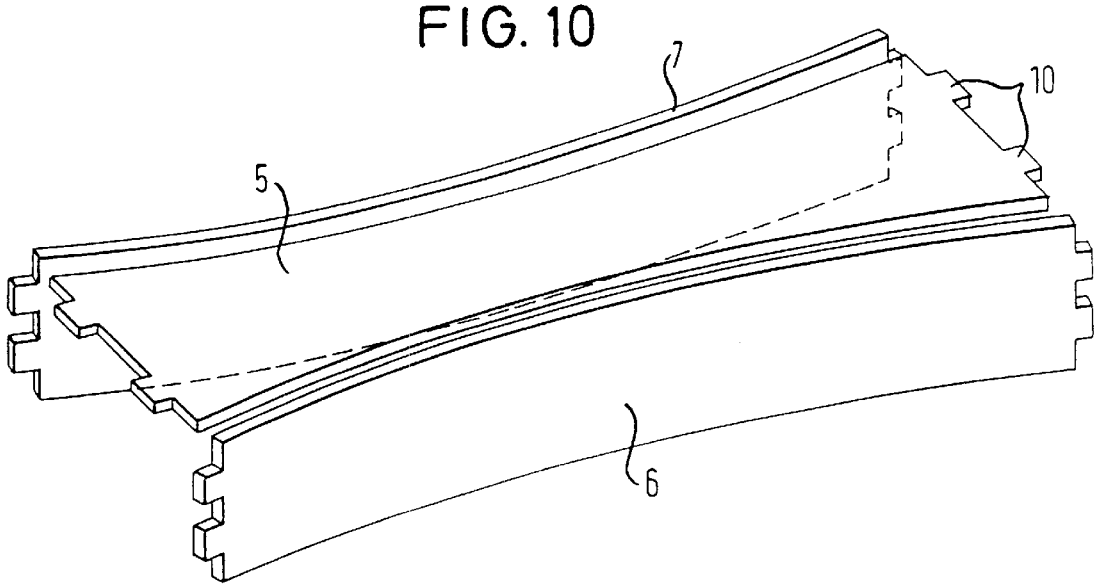
FIG. 10 is a perspective representation of the design of a lamp cover in accordance with FIG. 7.

The perspective representations in accordance with FIGS. 8, 9 and 10 show the lamp housings, which are respectively shown in a bottom view in FIGS. 5, 6, and 7, in their three-dimensional form, with it having to be noted here that the curvatures of the lateral areal elements 6, 7 are created in the embodiment in accordance with FIGS. 9 and 10 by the stress of the elements, which are planar per se, in the end walls of the lamp housing.

The coupling lugs 10 shown in the drawings, and naturally their complementary recesses 11 in the end walls of the respective lighting housing, can basically be designed in the most varied way. It is only necessary to ensure that the coupling lugs 10 can be inserted into the corresponding recesses by deformation of the respective areal element and that these lugs 10 engage into the corresponding recesses after the release of the areal elements, which are initially curved during mounting, such that a removal of the areal elements is only possible when these elements are again directly deformed or bent, such as will be the case when it becomes necessary to change a lighting means.

Substantial advantages of the lamp cover in accordance with the invention lie in their low weight, the simplicity of their production by punching, cutting or lasering, the variability with respect to their dimensions and shape, the avoidance of additional fastening elements such as clamps and the like, and in that the most varied radiation characteristics of a lamp can be achieved by the selection of the shape, the number and the position of the individual areal elements.

What is claimed is:

1. A lamp comprising a housing having opposing first and second, spaced-apart housing walls; a lamp mounted to the housing and extending in a longitudinal direction perpendicular to the housing walls; each housing wall including at least one cut-out extending in the longitudinal direction; and a cover for the lamp comprising at least one resiliently deformable areal element and terminating in end edges which are parallel to the housing walls, each end edge including at least one lug formed to be extendable through the openings in the housing walls, a spacing between ends of the lugs being greater than a spacing between the housing walls so that installation of the areal element in the housing requires a resilient deformation of the areal element about an axis that is perpendicular to the longitudinal direction to thereby reduce the spacing between ends of the lugs to enable the insertion of the lugs into the openings in the housing walls; whereby the release of the deformed areal element extends the lugs through the openings in the housing walls and thereby mounts the areal element to the housing and the areal element covers the lamp.

2. A lamp according to claim 1 wherein a spacing between end edges of the areal element is greater than the spacing between the housing walls so that installation of the areal element in the housing requires a resilient deformation of the areal element about the axis that is perpendicular to the longitudinal direction to thereby reduce the spacing between the end edges to enable positioning of the areal element between the housing walls and insertion of the lugs into the openings in the housing walls; whereby the release of the deformed areal element causes the end edges to engage the housing walls before the areal element is in its fully relaxed position and the installed element is one of concave and convex about the perpendicular axis and resulting stresses developed in the areal element bias the edges of the areal element against the housing walls.

3. A lamp according to claim 1 wherein the lugs have a substantially rectangular cross-section and the openings in the housing walls have a complementary rectangular cross-section.

4. A lamp according to claim 1 wherein the areal element comprises opaque plexiglass plates.

5. A lamp according to claim 1 including a lateral areal element extending in the longitudinal direction along each lateral, longitudinally extending side of the areal element, the lateral areal element including ends facing the housing walls and including at least one lug extending from the ends toward the housing walls, the housing walls including additional openings for receiving the lugs on the lateral areal elements, and a spacing between ends of the lugs on the lateral areal elements being greater than the spacing between the housing walls of the housing so that the lateral areal elements require resilient deflection about an axis that is perpendicular to the longitudinal direction for mounting the lateral areal elements to the lamp.

6. A lamp according to claim 5 wherein a spacing between end edges of the lateral areal elements is greater than the spacing between the housing walls so that the lateral areal elements have one of a convex and concave shape relative to an axis that is perpendicular to the longitudinal direction.

7. A lamp according to claim 6 wherein lateral edges of the areal element have at least one of a concave and convex shape which is complementary to the convex and concave shape, respectively, of the lateral areal elements.

8. A lamp according to claim 6 including at least one protrusion extending from the lateral edges of the areal element, the lateral areal elements have an opening for receiving the protrusion, and the protrusion extends through the opening in the lateral areal elements.

* * * * *